US006070367A

United States Patent [19]

Wagner et al.

[11] Patent Number: 6,070,367

[45] Date of Patent: Jun. 6, 2000

[54] FOLDING STAGE

[75] Inventors: Walter R. Wagner, Eden Prairie; Mark DeSimone, Hopkins, both of Minn.

[73] Assignee: Sico Incorporated, Minneapolis, Minn.

[21] Appl. No.: 08/904,707

[22] Filed: Aug. 1, 1997

[51] Int. Cl.[7] ..... E04H 3/28; A47B 3/00

[52] U.S. Cl. ..... 52/7; 108/115

[58] Field of Search ..... 52/7; 108/115, 108/124, 167, 168, 169, 171, 176, 172, 174; 16/18 A

[56] References Cited

U.S. PATENT DOCUMENTS

| | | |
|---|---|---|
| Re. 24,454 | 4/1958 | Wilson . |
| 89,306 | 4/1869 | Goodher . |
| D. 304,499 | 11/1989 | Rogers et al. . |
| D. 307,186 | 4/1990 | Rogers et al. . |
| 587,518 | 8/1897 | Bartelle . |
| 770,152 | 9/1904 | Bechtel . |
| 1,370,732 | 3/1921 | Corbett . |
| 1,614,539 | 1/1927 | Ryan . |
| 2,212,938 | 8/1940 | Hulscher . |
| 2,249,455 | 7/1941 | Caldwell . |
| 2,258,133 | 10/1941 | Chuma . |
| 2,278,817 | 4/1942 | Zeindler . |
| 2,368,748 | 2/1945 | Doty . |
| 2,508,627 | 5/1950 | Spiegel et al. . |
| 2,514,524 | 7/1950 | Steele . |
| 2,596,250 | 5/1952 | Klingler . |
| 2,621,095 | 12/1952 | Haumerson . |
| 2,645,539 | 7/1953 | Thompson . |
| 2,739,860 | 3/1956 | Wilson . |
| 2,747,958 | 5/1956 | Wilson . |
| 2,764,460 | 9/1956 | Nelson . |
| 2,766,089 | 10/1956 | Nielsen . |
| 2,771,937 | 11/1956 | Wilson . |
| 2,782,075 | 2/1957 | Fagan . |
| 2,831,741 | 4/1958 | Wilson . |
| 2,873,157 | 2/1959 | Wilson . |
| 2,887,348 | 5/1959 | Sadowsky . |
| 2,969,245 | 1/1961 | Wilson . |
| 2,977,169 | 3/1961 | Geller . |
| 2,978,754 | 4/1961 | Wilson . |
| 2,983,968 | 5/1961 | Wurn . |
| 2,993,740 | 7/1961 | Good . |
| 3,027,209 | 3/1962 | Nielsen . |
| 3,028,197 | 4/1962 | Wilson . |
| 3,034,843 | 5/1962 | Moon . |
| 3,075,809 | 1/1963 | Wilson . |
| 3,080,833 | 3/1963 | Risdall . |

(List continued on next page.)

FOREIGN PATENT DOCUMENTS

| | | |
|---|---|---|
| 0 389 932 | 3/1990 | European Pat. Off. . |
| 2 314 315 | 6/1975 | France . |
| 2 418 319 | 2/1978 | France . |
| 2 554 476 | 11/1983 | France . |
| 2 587 784 | 9/1985 | France . |
| 84 28 611 U | 1/1985 | Germany . |

OTHER PUBLICATIONS

"Sico Staging & Risers . . . Leading the Way." 4 Page Brochure by Sico Incorporated.

*Primary Examiner*—Carl D. Friedman
*Assistant Examiner*—Timothy B. Kang
*Attorney, Agent, or Firm*—Merchant & Gould P.C.

[57] ABSTRACT

A folding stage includes a folding linkage with cross mem bers and a center lock. The center lock has a handle below the cross members and off to the side of the cross members to prevent pinching of operators' hands and fingers. The folding linkage folds from a use position wherein stage decks are horizontal to form a stage surface to a storage position wherein the bottom of the stage decks oppose one another. In the fully folded position, stage support legs are angled inward slightly. Casters mount at an oblique angle to the telescoping legs and are moved closer to the telescoping legs to decrease the moment of inertia about the legs while maintaining sufficient contact with the floor. Torsion bars mount at the pivoting access of the frame and the telescoping legs to control folding speed. The folding portions of the frame and decks have a center of gravity which is aligned with the pivoting access to decrease the moment of inertia about the pivoting axis.

8 Claims, 7 Drawing Sheets

U.S. PATENT DOCUMENTS 3,099,480 7/1963 Wilson .
3,143,982 8/1964 Blink et al. .
3,245,363 4/1966 Amthor, Jr. .
3,276,401 10/1966 Wilson et al. .
3,338,726 8/1967 Katzfey et al. .
3,351,029 11/1967 Bue .
3,437,058 4/1969 Bue .
3,476,061 11/1969 Takahashi .
3,557,720 1/1971 Blink et al. .
3,799,073 3/1974 Nielsen .
3,861,325 1/1975 Bue et al. .
3,903,812 9/1975 Cowley .
3,999,491 12/1976 Wilson .
4,026,221 5/1977 Wilson et al. .
4,054,096 10/1977 Wilson et la. .
4,074,636 2/1978 Wilson .
4,104,835 8/1978 Bardwick, III .
4,133,271 1/1979 Carlson .
4,232,488 11/1980 Hanley .
4,327,650 5/1982 Bue .
4,570,751 2/1986 Kleu .
4,590,865 5/1986 Rutsche et al. .
4,615,279 10/1986 de la Haye .
4,627,364 12/1986 Klein et al. .
4,638,604 1/1987 Rogers et al. .
4,779,542 10/1988 Staten et al. .
4,779,878 10/1988 Betts et al. .
4,811,530 3/1989 Eyerly .
4,863,126 9/1989 Rogers et al. .
4,872,295 10/1989 Fujita .
4,917,217 4/1990 Rogers et al. .
4,934,113 6/1990 Hall et al. .
4,949,649 8/1990 Terres et al. .
4,979,340 12/1990 Wilson et al. .
4,995,679 2/1991 Segerljung ..... 16/18 A X
5,050,353 9/1991 Rogers et al. .
5,317,842 6/1994 Rogers et al. .
5,323,563 6/1994 Rogers et al. .
5,325,640 7/1994 Luedke et al. .
5,367,963 11/1994 Jaggi et al. .
5,615,451 4/1997 Peterson et al. .

FOLDING STAGE

BACKGROUND

1. Field of the Invention

The present invention is directed to a folding stage and in particular, to an elevationally adjustable mobile folding stage.

2. Prior Art

Folding stages are used for a variety of purposes to provide a temporary raised platform for use in schools, hotels, convention centers and other institutions or multiple use facilities requiring the capability of setting up temporary stages. Such stages may be positioned adjacent one another to form an extended stage surface or positioned to support bridging decks between the stages to form an extended stage surface. When not in use, the stages have a framework that folds to compact dimensions and stored along with the bridging decks. The stages typically have two stage decks hinged together to provide for folding action and have legs which remain vertical when the stage decks fold. An example of such a folding stage is shown in U.S. Pat. No. 5,325,640 to Luedke et al., issued Jul. 5, 1994, and assigned to Sico Incorporated, the assignee of the present invention. Although the Luedke et al. patent is very successful in providing efficient and useful folding stages, further improvements are still possible, particularly with regard to stages that fold from the use position to the storage position with the underside of the stages substantially opposing one another in the folded storage position. The support framework and legs of the stage must provide a wide stable base for supporting the stage to prevent wobbling or tipping. It can be appreciated that stability is important both when in a use position, as well as in the folded storage position. Although the Luedke et al. stage provides a stable base, in the storage position when the stage is supported on casters, the distance between the telescoping legs and the casters provides a relatively large moment force about the frame and causes stresses on the caster mounting structure. However, movement of the casters closer to the support legs decreases the width of the support base and the stability of the stage in the folded position.

The folding motion from the folded position to the unfolded position, as well as from the unfolded position to the folded position, should require substantially little effort To accomplish this, the decks and framework should pivot at a substantially center balanced point at the center of gravity so that undue force is not necessary. In addition, unbalance at any point in the range of motion may cause undue folding speed, so that decks may fall into place at either end of the range of motion. This can lead to accidents wherein hands and fingers may be pinched between linkage members or deck members.

In addition, a spacing linkage should provide locking movement and a handle to engage and disengage from a locking position. Such a handle should provide for aiding the folding motion of the stage. Although the Luedke et al. patent has a center lock linkage with a handle, it is in a position wherein hands and arms may be pinched between folding links as they move toward the folded position. This may cause safety concerns and reduced operational efficiency.

It can be seen then that there is a need for a folding stage that provides for a stable base without undue stresses on the casters and support frame in a folded position. In addition, it can be seen that further improvements are possible with regard to folding linkages, balance and torque, and accessibility of spacing linkages and associated handles.

SUMMARY OF THE INVENTION

The present invention is directed to a folding stage, and in particular to a folding stage that provides for easy folding and storage. The elevationally adjustable folding stage includes a framework folding along a center line and supporting two stage decks which form a horizontal stage surface. The telescoping legs pivotally connect to the framework and provide for supporting the framework in the folded, as well as unfolded position. The framework includes a linkage that folds the stage between the use position and the storage position wherein the undersides of the stage decks substantially oppose one another. The legs telescope to provide for elevational adjustment of the stage surface.

The folding linkage includes cross links which connect between a telescoping leg and opposed frame member under a stage deck. The links generally cross at an angling configuration. The links include a first section, a second center section and a third section. The first section is angled relative to the second center section at an obtuse angle while the third section is angled in the opposite direction at an obtuse angle to the second center section. One of the links also bends inwardly toward the stage so that it may mount from the outside of the frame member to the telescoping leg, which is positioned inward from the edge of the frame. The stage also includes an over center lock which helps to maintain the stage in the unfolded position. The center lock linkage includes a stop between the links and is free floating on the pivot. The stop includes a tab which engages one of the spacing links and an oppositely extending tab engaging the other of the spacing links and acting as a handle for moving the center lock linkage between the folded and unfolded position. The configuration of the folding linkage cross links also provides for avoiding interference with the stop member and interference in accessing the handle member. In the folded position, the stop is spaced apart to one side of the folding linkage so that it is not between the folding links and does not pinch the operator's hands or fingers.

The present invention also provides for the telescoping leg members extending slightly outward in the folded position rather than extending vertically. The casters are moved closer to the telescoping legs so that the moment about the caster support assembly is decreased while the width of the support points is not narrowed. This configuration causes less stress and improved durability. As the telescoping legs are angled slightly outward in the folded position, the casters are angled slightly inward to maintain substantial contact with the floor and provide a more solid support base in a folded position.

To ensure that the folding operation does not happen too quickly or require too much effort, the frame and deck are balanced so that less effort is required to fold and unfold. However, it can be appreciated that as the linkage and the frame and decks pass from the folded to the unfolded position, there may be minor shifts in the center of gravity. Therefore, the present stage utilizes torsion bars placed along the axis of rotation of the decks and frame relative to the legs which is also aligned with the center of gravity of the pivoting portion. The torsion bars prevent slamming of the stage as it is folded and unfolded. To accomplish this, the torsion bars bias toward a first angular direction and a second opposite angular direction. The neutral position is at a slightly unfolded position at approximately one third of the way through the range of motion.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT

Figure 1:
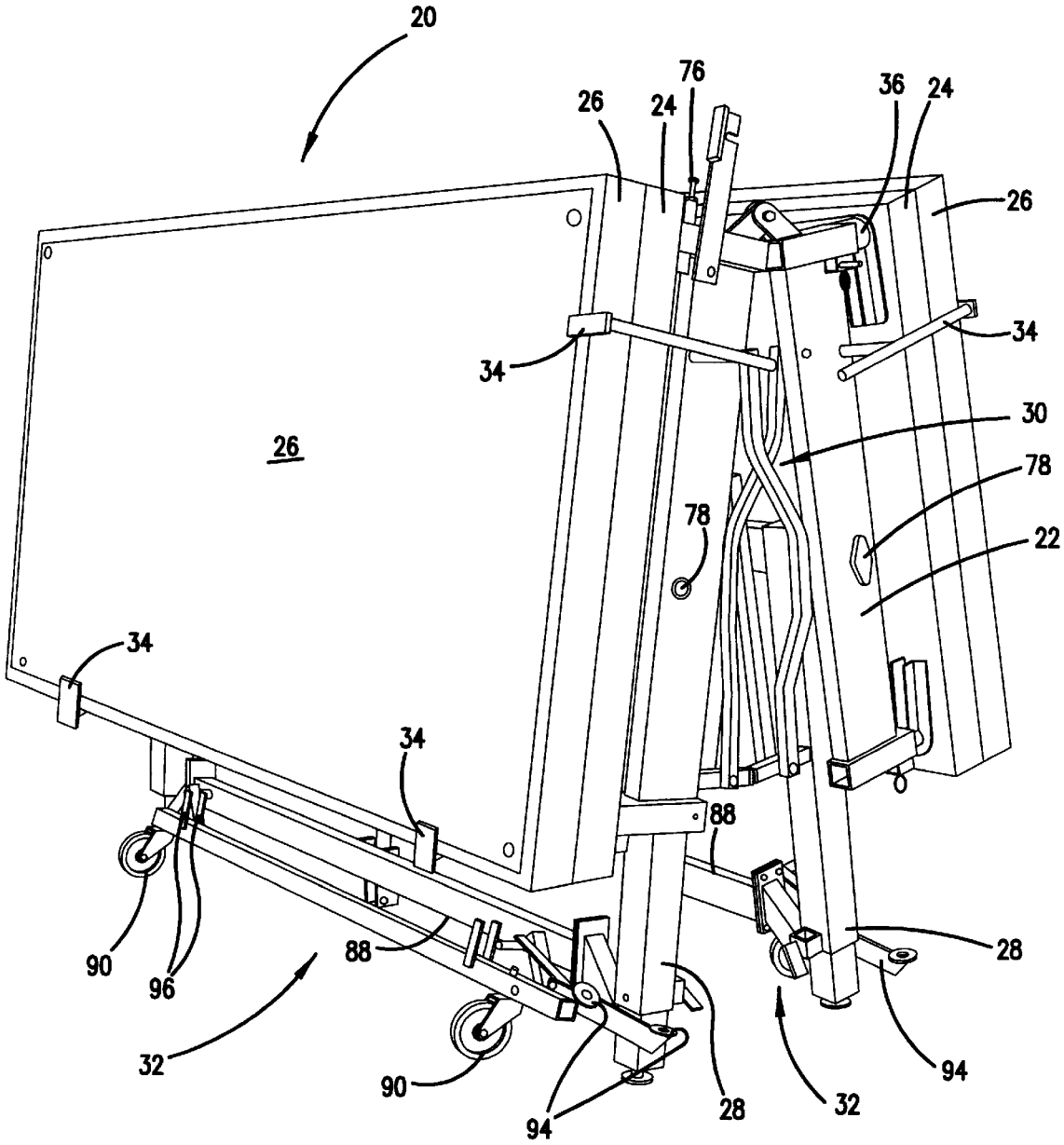
FIG. 1 shows a perspective view of an elevationally adjustable folding stage according to the principles of the present invention in a folded storage position.
Figure 2:
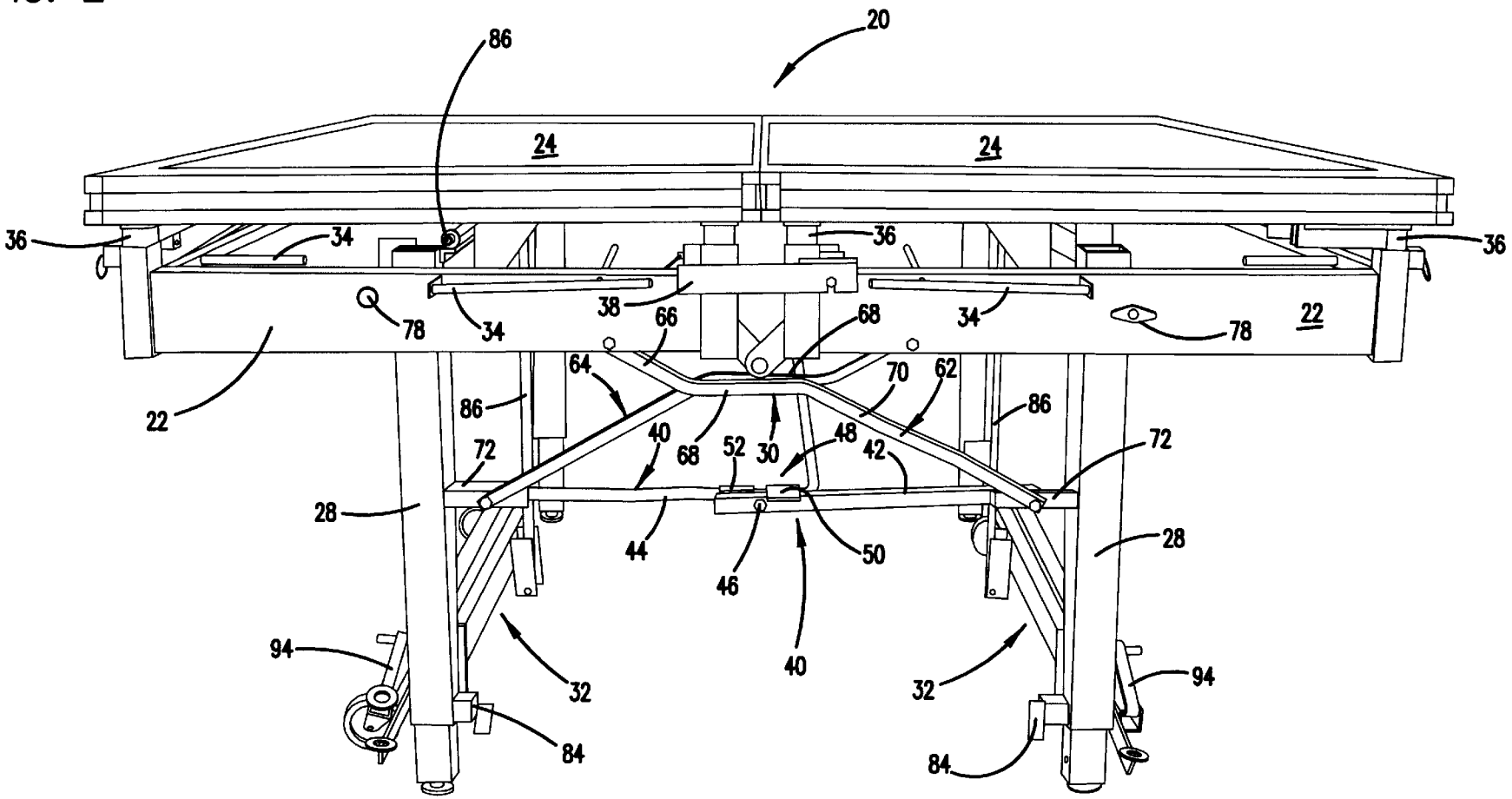
FIG. 2 shows a perspective view of the elevationally adjustable folding stage of FIG. 1 in an unfolded use position.

Referring now to the drawings, and in particular to FIGS. 1 and 2, there is shown an elevationally adjustable folding stage, generally designated 20. The stage 20 folds between a use position shown in FIG. 2 and a folded storage position shown in FIG. 1. In the use position, a pair of stage decks 24 form a substantially planar upper stage surface. The decks 24 are supported on a frame 22 and telescoping legs 28. A linkage 30 facilitates movement between the folded and unfolded positions. The stage decks 24 are connected to supports 36 which may also be configured for supporting additional bridging decks 26 between stages to form an extended stage surface. In the storage position, the bridging decks 26 may be positioned on top of the stage decks 24. Retainers 34 pivot outward and retain the bridging decks 26 against the stage decks 24, even in the folded position.

Figure 4A:
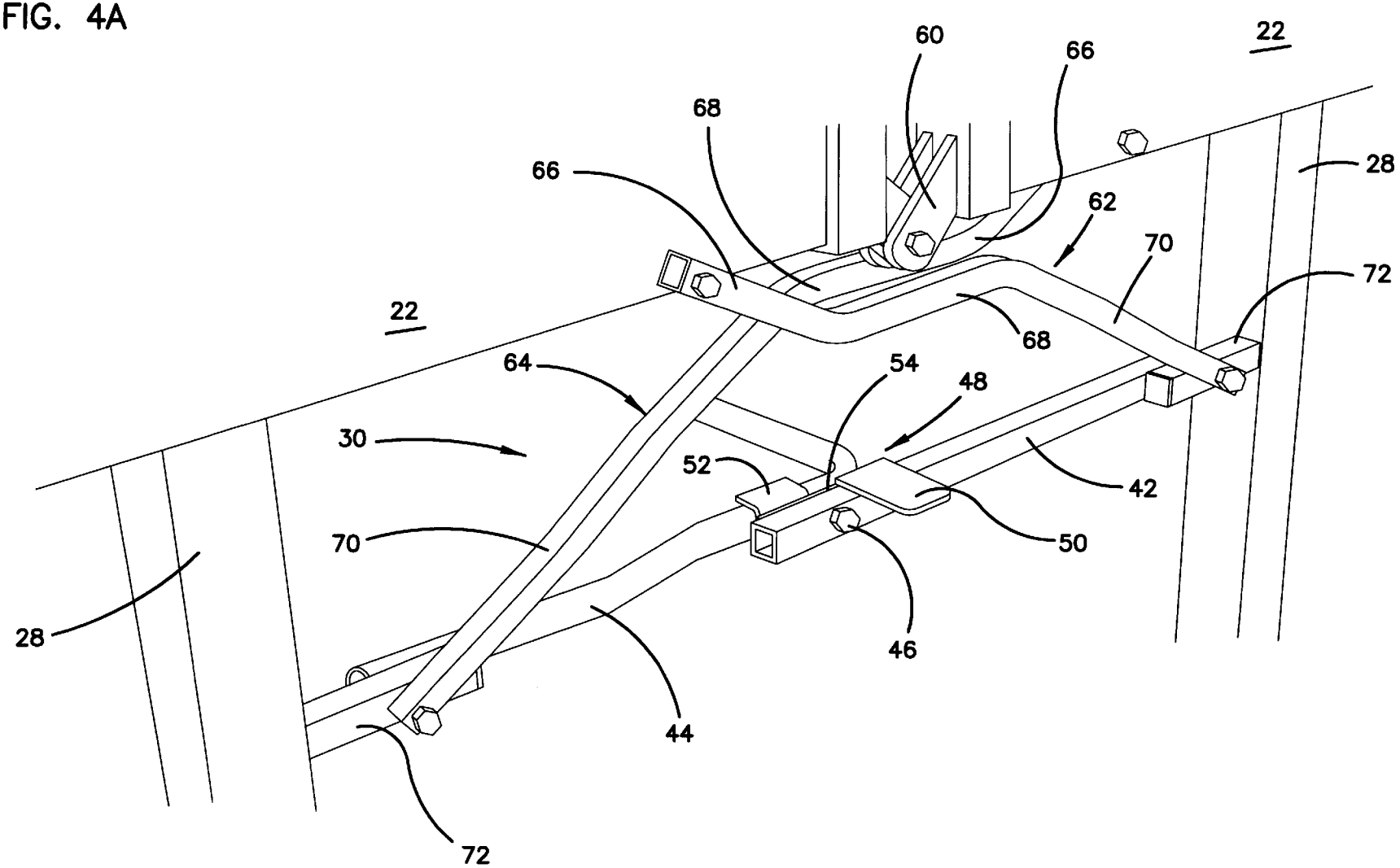
FIGS. 4A and 4B show perspective views of the folding stage of FIG. 1 in a partially unfolded position.
Figure 4B:
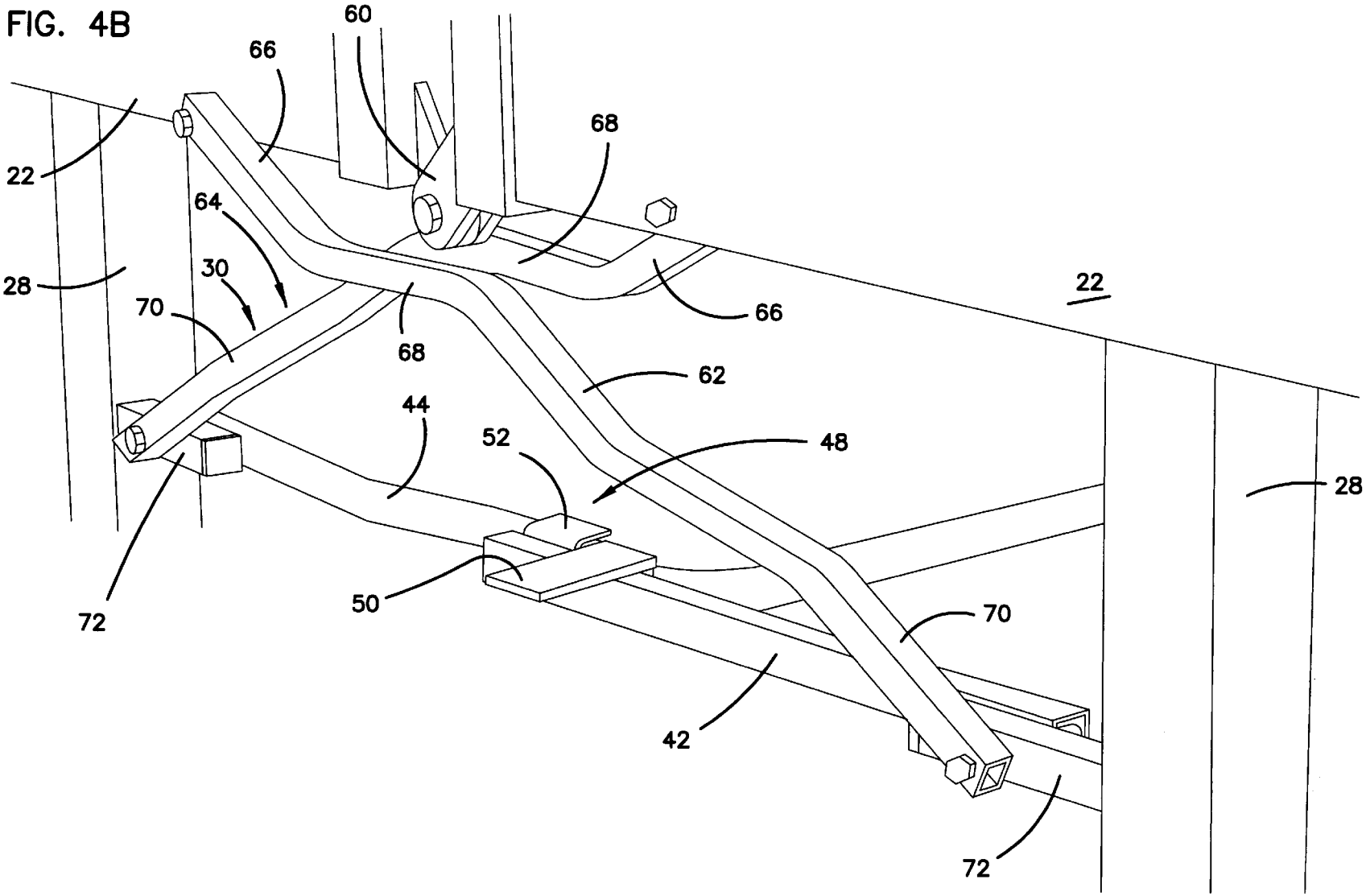
Figure 5:
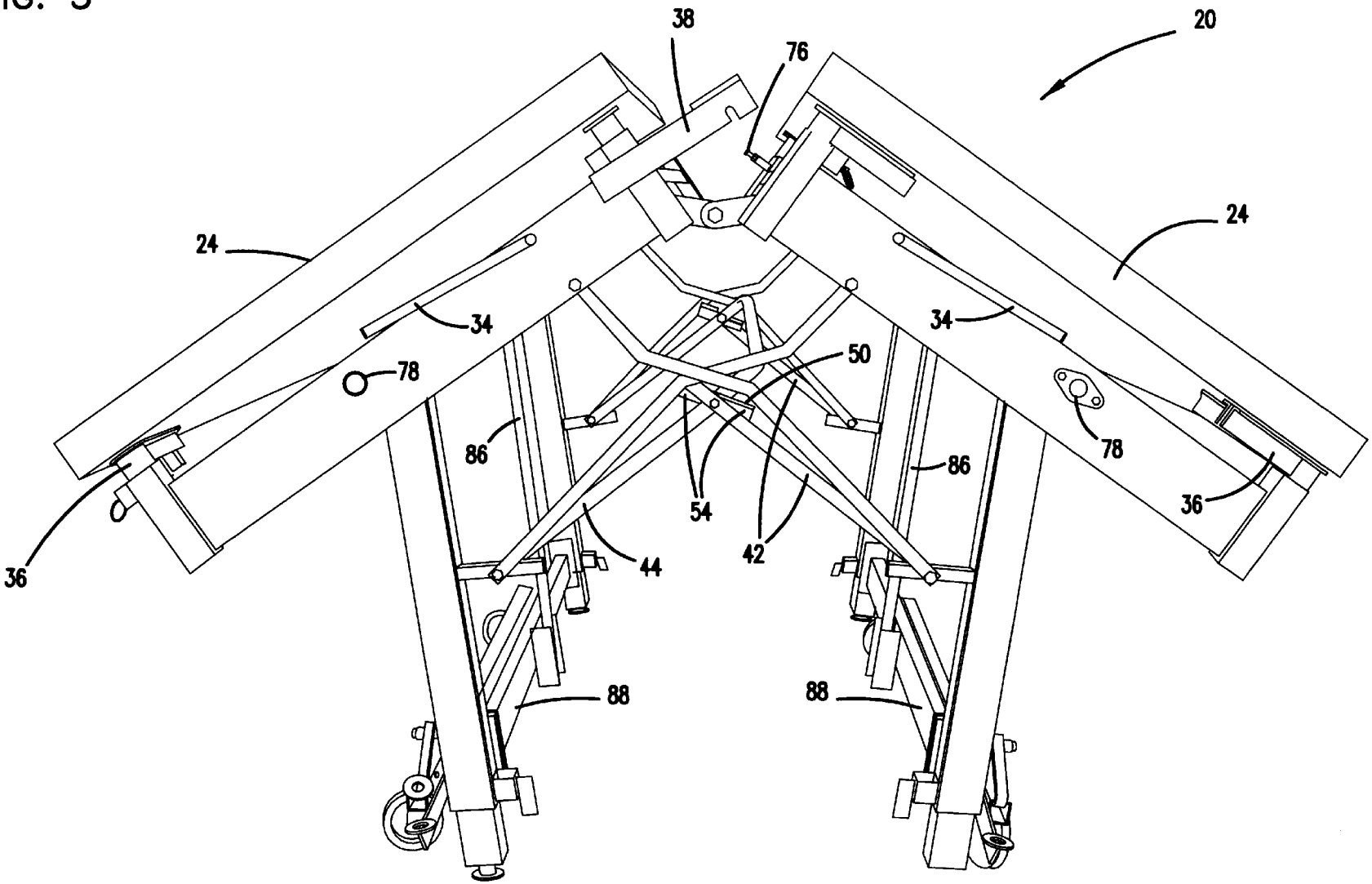
FIG. 5 shows a perspective view of the folding linkage and spacing linkage for the folding stage of FIG. 1 in an unfolded position; and, FIG. 6 shows an end elevational view of a telescoping leg and caster assembly for the folding stage of FIG. 1.

As shown in FIGS. 1–5, the linkage 30 includes a frame hinge 60 extending between the frame elements 22 as well as a first link 62 and second link 64, extending between the frame elements 22 and the oppositely disposed telescoping leg 28. In the embodiment shown, the first link 62 includes a first section 66 connecting to a second center section 68 and a third section 70. The second link 64 includes similarly spaced sections, but for identification purposes, reference will be made only to one link. The first and second sections 66 and 68 are connected at an obtuse angle to one another, so that in the use position shown in FIGS. 2 and 5, the center section 68 is substantially horizontal while the first section 66 angles upward. The third section 70 connects to an opposite end of the center section 68 and extends at an obtuse angle in an opposite downward extending direction, as shown in FIGS. 2 and 5 in the use position. As shown in FIG. 1, in the folded position, the links cross at the second sections 68. As explained hereinafter, this provides for a narrower profile at that portion of a folding linkage 30 and for placement of a over center lock stop 48 to be positioned outside of the interior of the crossing pattern of the links 62 and 64. As shown in FIG. 2, the links 62 and 64 are spaced above the over center lock stop 48, and the linkage 30 does not interfere with access to the over center lock stop 48.

It can also be appreciated that the links 62 and 64 must connect to the frame 22 as well as to mounting arms 72 on the telescoping legs 28. From an end perspective, it can be appreciated that the legs 28 are positioned interior of the outer edge of the frame members 22. Although the second link 64 may extend in the same vertical plane as both pivot points, the first link 62 is mounted on the outer edge of the frame member 22 and must be mounted to an inner portion of the telescoping leg 28. The mounting arm 72 provides a pivot point for the lower portion of the folding linkage links 62 and 64. Therefore, the first link also includes bends angling inward along the third section 70 to provide the adjustment between the outer edge of the frame section 22 and the mounting arm 72 on the opposite telescoping leg 28 as shown most clearly in FIG. 5. The frame sections 22 are also joined by a frame hinge 60 along the center line of the folding stage 20. As shown in FIGS. 1 and 5, adjustable spacer pins 76 extend inward from the frame to engage the opposed frame and ensure a proper fit and alignment along the center line of the stage 20. To ensure that the stage 20 does not accidentally fold from the use position, a lock member 38 includes a catch for engaging a pin on the opposite frame member. The lock 38 is disengaged prior to folding and unfolding and engaged only in the fully unfolded position.

Figure 3:
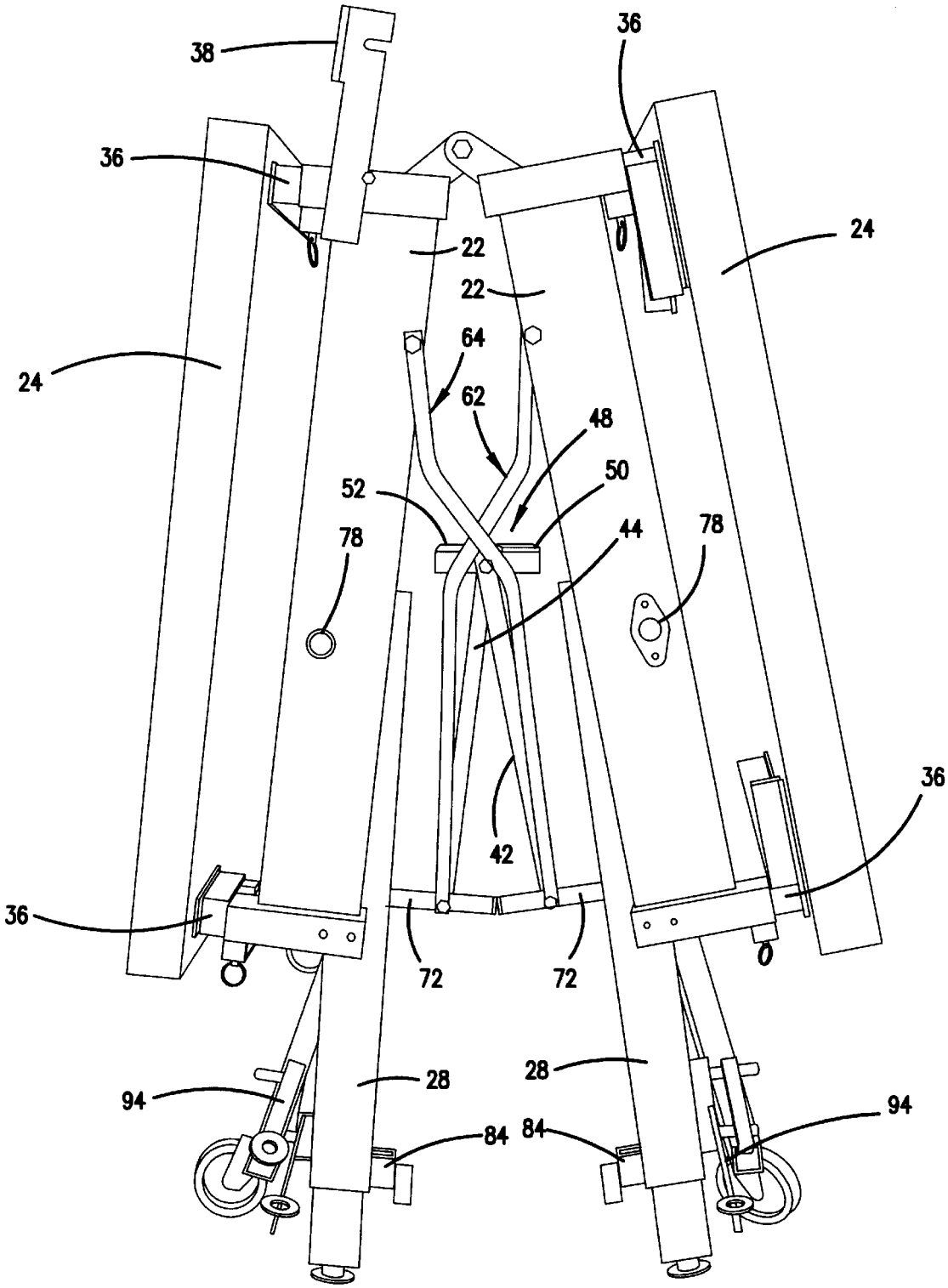
FIG. 3 shows an end elevational view of the folding stage of FIG. 1 in a folded storage position.

As shown most clearly in FIGS. 4A and 4B, the over center lock 40 extends below the folding linkage 30. The over center lock 40 includes an outer link 42 and an inner link 44 extending between mounting arms 72 on the legs 28. A stop 48 mounts to a center pivot 46. The stop 48 includes a flange or handle 50 extending outward and acting as a grip portion as well as a tab 52 extending over the inner link 44. A mounting segment 54 extends vertically between the links 42 and 44 and mounts to the pivot pin 46. The over center lock 40 passes through a toggle point to a locking position by pushing the handle 50 down. By lifting the handle 50, the over center lock 40 can be disengaged and folding of the stage can be accomplished. As the handle floats on the pivot pin 46 rather than being joined as an extension of one of the links 42 or 44, upward pressure can be applied by pulling up on the handle 50. It can also be appreciated that as the stop 48 may be kept substantially horizontal, it may be pulled or pushed upward during the entire range of motion. The stop 48 extends at one side of the crossing pattern of the folding linkage 30 in the fully folded position, as shown in FIG. 3. This positioning avoids pinching as may occur if the stop 48 is between the links of the spacing linkage 30. It can also be appreciated that the tab 52 and flange 50 push downward on their respective links 44 and 42, to ensure secure positioning of the over center lock 40. In the unfolded position, the links 62 and 64 clear the handle 50 and do not interfere with its access.

To facilitate folding and unfolding and to control the speed of the folding and unfolding operation to avoid slamming and problems associated with edges folding too quickly, a torsion bar 78 extends along each axis of rotation for the frame 22 pivoting about the legs 28 within the tubular member of the frame extending parallel to the folding centerline along each half of the stage. Torsion bars 78 are well known in the art, however they have not been used to limit the speed of folding. According to the present invention, the torsion bars 78 bias in a first angular direction and a second opposed angular direction from a neutral position. In this manner, with the decks 24 and frame 22 being balanced about the axis of rotation, no great torque or moment of inertia is created as the center of gravity is substantially aligned with the axis of rotation and moves little during the folding range of motion. Moreover, the moment about the axis is counteracted by the force of the torsion bars 78, which prevent undue acceleration through any portion of the folding motion. The neutral position for the torsion bars 78 is at a partially unfolded position nearer the fullly folded position, at approximately one third of the way through the folding motion to provide added force at the unfolded position. The neutral position occurs when the stage 20 is at a position intermediate the positions shown in FIGS. 1 and 5.

Inner telescoping legs 80 extending outward from the upper outer legs 82. Spring loaded height adjustment pins 84 engage corresponding orifices in the legs to maintain the stage at the desired height. A height adjustment lift device 86 raises each side of the stage relative to a crossbar 88 extending between the inner telescoping legs on each side of the stage. Such a device is typically actuated by an electric drill or other device for easy operation and movement between different heights. It can be appreciated that according to the present invention, the legs 28 are vertical in the use position shown in FIG. 2. However, in the storage position as shown in FIGS. 1 and 3, the legs angle outward slightly, each leg 28 at an angle of about 5.5 degrees from vertical widening the base of support for the stage 20 in the folded position.

Figure 6:
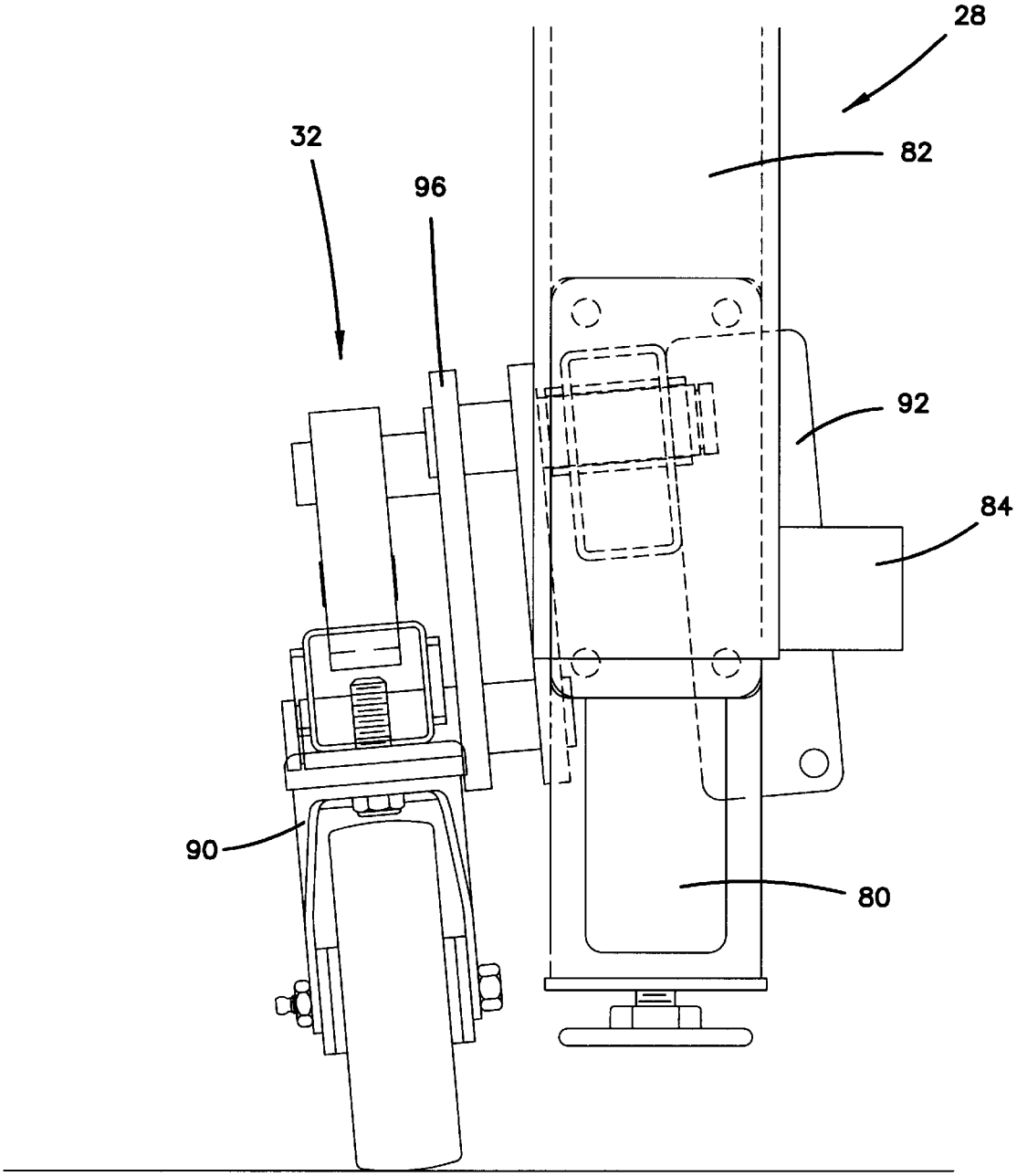

The caster assembly 90 is mounted at a slight angle relative to the telescoping legs 28. As shown most clearly in FIGS. 3 and 6, the casters 90 mount on a bar 92 angled inward slightly toward the telescoping leg. However as the legs 28 extend slightly outward in the folded storage position, substantial contact is maintained between the casters 90 and the floor. The caster mounting bar 90 is at a 5 degree angle relative to the legs 28. In the unfolded position shown in FIG. 6, the caster is at an angle of approximately 3.5 degrees from vertical, due to tolerances in the assembly 90. In the folded position, as shown in FIG. 3, the casters 90 are at a 2.5 degree angle from vertical. The caster assembly 32 also includes a lift mechanism as described in U.S. Pat. No. 5,615,451 and mounting links 96 which raise and lower the stage relative to the casters 90, so that the telescoping legs 28 can engage the floor or can be lifted off the floor for easily rolling the stage 22 to the desired location. As the casters 90 are angled slightly inward and maintain contact, the legs 28 can be angled outward. Therefore, the distance between the casters 90 and the legs 28 can be decreased. This configuration maintains the casters 90 at the same distance apart and maintains the stability of the stage 20 when supported on the casters 90, even in the folded position. However, as the distance decreases between telescoping legs 28, and the caster mounting bar 92, the moment about the caster assembly 92 is decreased. Therefore, with less torque, there is less stress and greater safety as there is less chance of the caster assembly failing due to the moment force about the caster assembly 32 and the folded position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An elevationally adjustable folding stage, comprising:

a frame;

a pair of stage decks having an upper surface and a lower surface;

telescoping legs mounted to the frame;

a folding linkage having cross links for folding the stage from a use position wherein the stage decks extend horizontally and the telescoping legs extend vertically, and a storage position wherein the lower surfaces of the stage decks oppose one another and the telescoping legs angle toward one another at an upper end; and a center lock having a spacing linkage with an inner spacing linkage link and an outer spacing linkage link extending between opposed telescoping legs, and a stop mounted to a pivot pin extending between the spacing linkage links, the stop having a handle extending above and outward beyond the outer spacing linkage link.

2. A stage according to claim 1, wherein the handle is directly accessible from an end of the stage in the folded position without reaching between the links of the folding linkage.

3. A stage according to claim 1, wherein the flange engages the outer spacing linkage link and the tab engages the inner spacing linkage link when the spacing linkage passes through a toggle point to lock the spacing linkage, thereby locking the stage in an unfolded position.

4. A stage according to claim 1, wherein the stop includes a tab extending inward above the inner spacing linkage link.

5. An elevationally adjustable folding stage, comprising:

a frame;

a pair of stage decks having an upper surface and a lower surface;

telescoping legs mounted to the frame;

a folding linkage having cross links for folding the stage from a use position wherein the stage decks extend horizontally, and a storage position wherein the lower surfaces of the stage decks oppose one another;

a spacing linkage extending between opposed telescoping legs and having an inner link and an outer link connected by a pivot pin; and a center lock mounted to the pivot pin intermediate the inner and outer spacing linkage links, wherein the center lock includes a flange extending above the outer spacing linkage link and a tab extending above the inner spacing linkage link.

6. A stage according to claim 5, wherein the flange comprises a handle extending outward beyond the outer spacing linkage link.

7. A stage according to claim 5, wherein the flange engages the outer spacing linkage link and the tab engages the inner spacing linkage link when the spacing linkages passes through a toggle point to lock the spacing linkage, thereby locking the stage in an unfolded position.

8. A stage according to claim 7, wherein the flange comprises a handle extending outward beyond the outer spacing linkage link.

* * * * *